US005092802A

United States Patent [19]

Jones

[11] Patent Number: 5,092,802

[45] Date of Patent: Mar. 3, 1992

[54] BODY BUOY

[76] Inventor: Carolyn S. Jones, 2101 N. Vancouver, Tulsa, Okla. 74127

[21] Appl. No.: 534,335

[22] Filed: Jun. 4, 1990

Related U.S. Application Data

[60] Continuation of Ser. No. 303,826, Jan. 30, 1989, abandoned, which is a division of Ser. No. 70,546, Jul. 7, 1987, abandoned, which is a continuation-in-part of Ser. No. 775,792, Sep. 13, 1985, abandoned.

[51] Int. Cl.[5] ..... B63C 9/08

[52] U.S. Cl. ..... 441/106; 441/88

[58] Field of Search ..... 441/88, 102, 106, 108, 441/113, 115, 120; D12/237, 238; D2/10, 27; 2/267

[56] References Cited

U.S. PATENT DOCUMENTS

D. 280,005 8/1985 Jones ..... D21/238

4,291,427 9/1981 Rhea ..... 441/120

4,619,622 10/1986 McDonald et al. ..... 441/115

4,668,202 5/1987 Scheurer et al. ..... 441/113

*Primary Examiner*—Ed Swinehart

*Attorney, Agent, or Firm*—Head & Johnson

[57] ABSTRACT

A body buoy made of a continuous piece of e.g., one or more inches thick rubberized foam rubber or other buoyant material with shoulder members and arm openings and may be worn as a vest. The lower torso body buoy continues three to six inches above the waistline to give an upper section which provides increased buoyancy and stability to the wearer when in water. This holds the body higher out of the water and completely frees the arms and permits their free use. This is most useful for the wearer when working or playing water sports such as water polo or performing marine maintenance.

4 Claims, 3 Drawing Sheets

BODY BUOY

This is a continuation of copending application Ser. No. 07/303,826 filed on Jan. 30, 1989 which is a division of Ser. No. 70,546 filed Jul. 7, 1987, which is continuation-in-part of 775,792, filed Sep. 13, 1985, all now abandoned.

BACKGROUND OF THE INVENTION

This invention relates to a body buoy which is to be worn over a swimming suit or other clothing. There are various type garments having inflatable means that can be inflated for supporting a person in the water. These include U.S. Pat. Nos. 3,098,248; 2,490,556 and 3,681,800. U.S. Pat. No. 4,291,427 is a floatation garment adapted to aid in keeping the user afloat in the water and has at least one floatation pad of a suitable flexible floatation material of a predetermined thickness. The pad requires one or more lines of reduced thickness extending across the pad to give it flexibility at these points. This floatation garment resembles swim trunks and extends from the crotch at the bottom to the waist at the top.

SUMMARY OF THE INVENTION

In one embodiment this is a buoyant body buoy to be worn on the lower portion of the torso over the swimsuit of a person participating in water activities such as working on a boat or water polo. The body buoy is preferably made of a continuous or unitary piece of floatation material such as rubberized foam of a selected thickness and which is firm but not completely rigid. The body buoy has two leg holes at the bottom and the body buoy is contoured to fit the human torso. It includes an upper section which extends above the waistline, e.g., three to six inches. This additional height gives the wearer added buoyancy and stability when performing water activities.

The body buoy has a slit down the front to facilitate putting on and removing it. Strap means are provided to secure the body buoy to the wearer. In another embodiment, the body buoy, while having essentially the same shape as that just described, does not have the slit in front, but rather has a slit on each side from the top to the leg opening. This embodiment is especially easy to put on and remove.

It is an object of this invention to provide a buoy for people playing or working in water that will give them greater buoyancy and stability in the water but still permit free use of the arms. It is another object of this invention to provide an invertible body buoy that can be worn over the lower torso somewhat like shorts. Various other objects and a better understanding of the invention can be had from the following description taken in conjunction with the drawings.

DETAILED DESCRIPTION OF THE INVENTION

Figure 1:
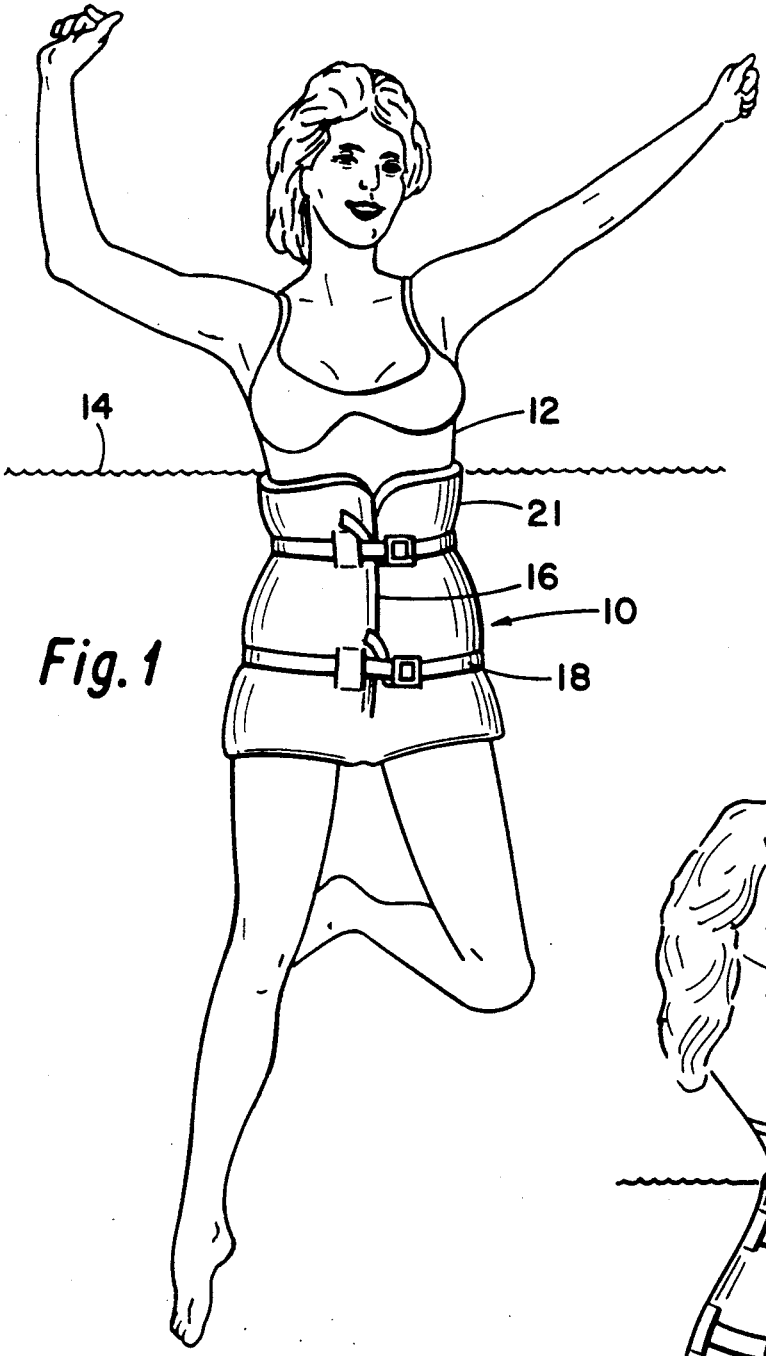
FIG. 1 shows one embodiment of my body buoy worn by a person floating in water.
Figure 2:
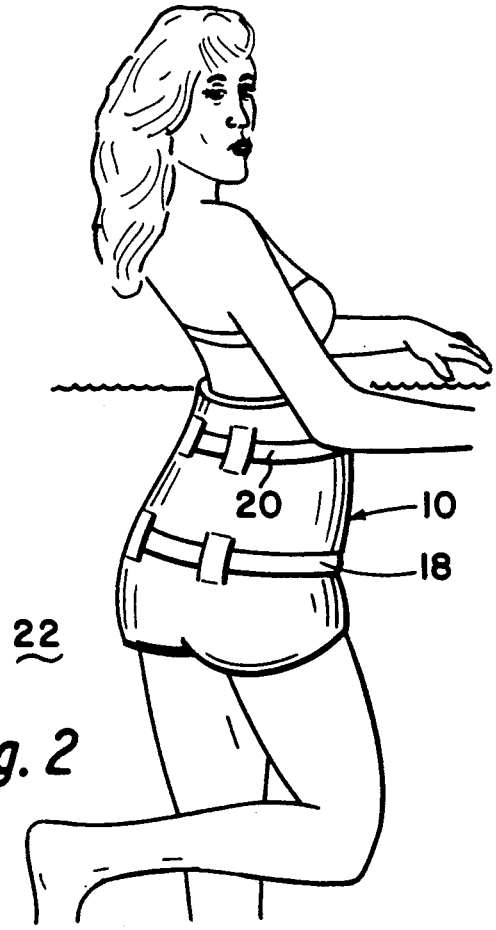
FIG. 2 shows an angle view of the rear side of the wearer of FIG. 1.

Attention is first directed to FIGS. 1 and 2. Shown therein is a swimmer 12 wearing my body buoy 10 and is floating in a body of water 22 having a surface 14. The body buoy 10 is provided with a slit 16 down the front and is secured to the body of the wearer by straps 18 and 20. Strap 18 is about the hips of the wearer and strap 20 is about the waist. As shown, there is an upper section 21 which extends above the waist a sufficient distance to give additional buoyancy and stability to the wearer. This extension may be, for example, about three to six inches. In a preferred embodiment it will extend at least up to, and preferably slightly above, the costal margin or about the point where the costal cartilages connects to the sternum. The body buoy 10 has sufficient buoyancy so that the head, arms and upper chest are above the water and are free for any activity desired. The body buoy may be molded to fit the contour of a human body including all of the hip portion. It is also preferably made of thicker material at the top than it is about the leg opening so that the center of buoyancy is higher and will thus hold the wearer higher out of the water.

Figure 3:
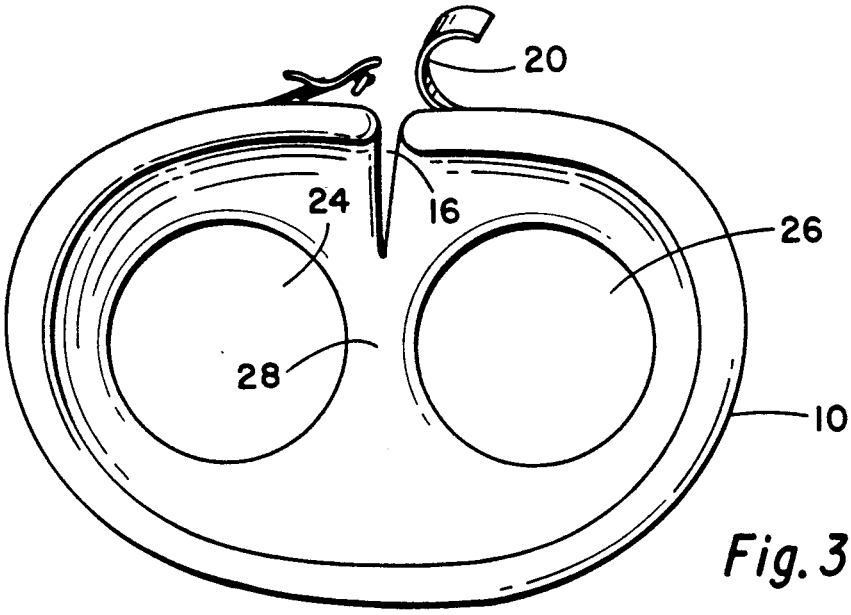
FIG. 3 is a plan view looking down from the top of my body buoy of FIG. 1.
Figure 4:
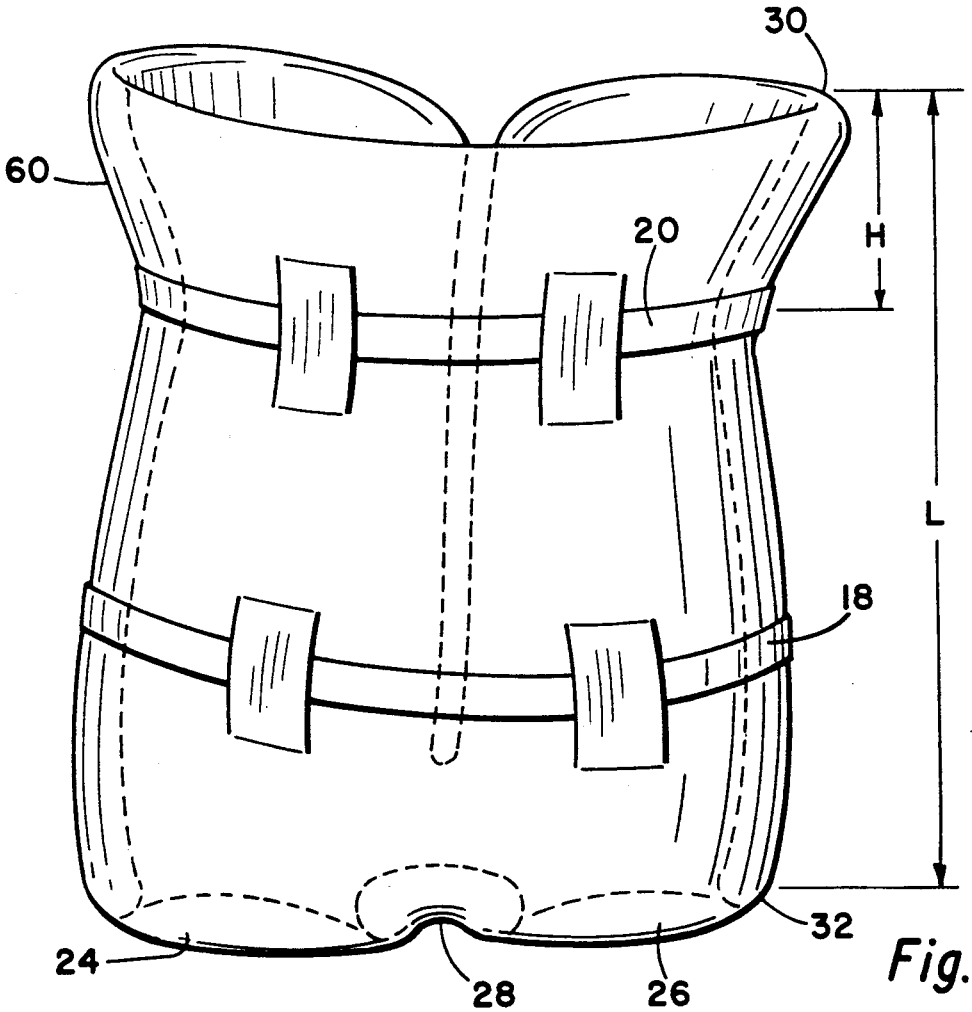
FIG. 4 is a rear elevation view of my body buoy of FIG. 1.

Attention is next directed to FIGS. 3 and 4 to show a more detailed drawing of the construction of this embodiment of my body buoy. My body buoy 10 is preferably made of a continuous piece of firm floatation material such as a rubberized foam or a closed cell, polyvinylchloride, expanded foam material. This material is preferably at least about one inch thick but may be thicker, especially at the top. If the position of the body buoy that is above the waist is thicker than that below the waist it will raise the center of buoyancy. As shown in FIGS. 3 and 4, there are leg openings 24 and 26 and a crotch 28 therebetween.

The height of the body buoy above the waist is shown in FIG. 4 to be that distance between belts 20 and the top 30 and is indicated by the symbol "H". The total distance of the body buoy from the bottom point 32 to the top 30 is indicated by the symbol "L". The dimension H must be sufficient to give the wearer adequate buoyancy and stability. The ratio of H over L may be in the range of about 0.20 to about 0.50 but a ratio of 0.20 is preferred. This is for those body buoys in which the material is of reasonably uniform composition and thickness throughout a substantial part of its floatation construction. The portion of my body buoy above the waist which is above the belt 20 can be identified as upper section 60. Without the upper section 60, that is if I stop at the waist as is the conventional practice of swim trunks, then the wearer would not have sufficient buoyancy and stability in the water desired to perform certain acts such as playing water polo or performing marine maintenance. The top 30 of the upper section 60 would preferably come up to at least about midway on the rib cage of the wearer which is in about the vicinity of the costal margin. It is to be noted also that the average person, when wearing my body buoy just described, will be held sufficiently high in the water so that the hands and arms are relatively free to perform functions such as catching a ball or doing work, on the side of a boat. By making section 60 thicker than the lower portion helps this distribution of buoyancy.

Figure 7:
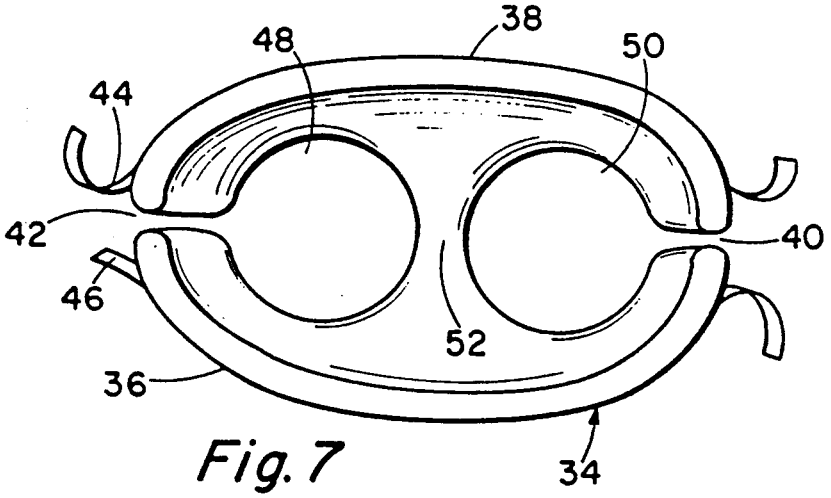
FIG. 7 is a plan view of the body buoy in FIG. 5.
Figure 6:
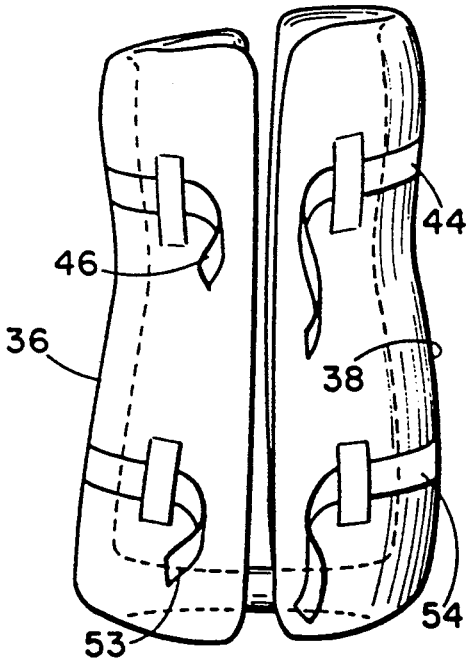
FIG. 6 is a side elevation view of the body buoy of FIG. 5.
Figure 5:
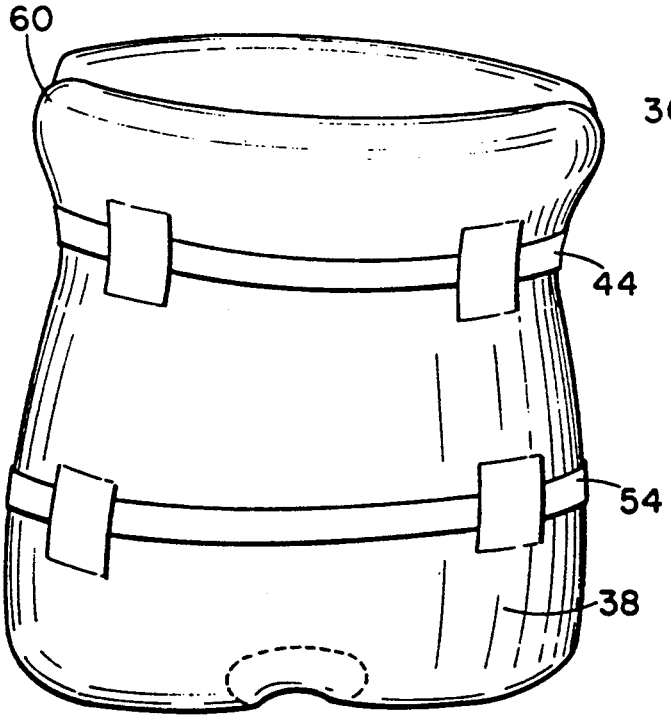
FIG. 5 is a rear elevation view of another embodiment of my body buoy.

Attention is next directed to FIGS. 4, 6 and 7 to show another or second embodiment of my body buoy. Except for a change in the structure which permits a different manner of putting on and taking off the body buoy, this embodiment is essentially the same as that described above. As shown in FIGS. 5 and 6, this device has a front section 36 and a rear section 38 which are held together by straps 44 and 54 which are tied together or connected in some manner with straps 46 and 53 respectively. As shown in FIGS. 6 and 7, there is no front split, but rather there is a side split 40 and 42. The body buoy of the first described embodiment can be put on by stepping into the holes 24 and 26. In this embodiment, one steps into the body buoy with the front half and back half 36 and 38 held wide apart and merely steps over crotch 52. One then pulls the front section 36 and back section 38 upwardly toward the body of the wearer and then ties or connects straps 44 and 46 and 54 and 53 in any well known manner such as by use of flexible releasable grippers or buckles or the like.

The material of the body buoy should be such that it is firm but not absolutely rigid. The section 60 must be such that it will extend upwardly in a reasonably set position so as to give the wearer great buoyancy and stability in the water. There is little flexing or bending required of the buoy except a sufficient amount to let it be put on and removed.

While this invention has been described with a certain degree of particularity, it is manifest that many changes may be made in the details of construction without departing from the spirit and scope of the disclosure. It is understood that the invention is not limited to the embodiment set forth herein for purposes of exemplification, but is limited only by the scope of the attached claim or claims, including the full range of equivalency to which each element thereof is entitled.

What is claimed:

1. A body buoy for the lower portion of the torso of a human being, such lower portion having a front, a back and a hip area and including an upper part above the waist and extending up to about the middle of the rib cage at about the connection of the costal cartilages with the sternum which comprises:

a continuous unitary piece of molded floatation material having two leg openings at the bottom and defining a crotch therebetween and contoured to fit and cover a human lower portion of said torso including all of the hip area from the waist to the crotch and further including an upper section, said piece extending above said waistline to approximately the sternum and across said front in a line lying in one plane, said piece also having a slit from the top of said upper section down to at least substantially below the waistline to facilitate putting on and removal of said body buoy;

means to hold said slit in a closed position.

2. A body buoy as defined in claim 1 in which said slit extends to near said crotch.

3. A buoyant body buoy as defined in claim 1 in which said slit is on one side of the body buoy and extends the full length thereof from the top to the leg opening and in which there is another slit on the other side thereof extending the full length.

4. A body buoy as defined in claim 1 in which said upper section has a height H which is between about 0.20 and 0.50 of the height L of the vertical dimension of one side of said body buoy.

* * * * *